US005333587A

United States Patent [19]

DiSilvestro et al.

[11] Patent Number: 5,333,587

[45] Date of Patent: Aug. 2, 1994

[54] MANIFOLD FOR A SYSTEM FOR SUPPLYING FUEL TO AN INTERNAL-COMBUSTION ENGINE

[75] Inventors: Maurizio DiSilvestro, Bologna; Flavio Giovannini, Casalecchio Di Reno, both of Italy

[73] Assignee: Weber S.r.l., Turin, Italy

[21] Appl. No.: 63,805

[22] Filed: May 20, 1993

[30] Foreign Application Priority Data

May 21, 1992 [IT] Italy ..... 000138

[51] Int. Cl.[5] ..... F02M 55/02; F02M 41/00

[52] U.S. Cl. ..... 123/456; 123/468

[58] Field of Search ..... 123/456, 514, 469, 470, 123/468, 463

[56] References Cited

U.S. PATENT DOCUMENTS

| | | | |
|---|---|---|---|
| 4,756,289 | 7/1988 | Rock | 123/467 |
| 4,805,575 | 2/1989 | de Coucini | 123/456 |
| 4,922,958 | 5/1990 | Lemp | 123/456 |
| 4,955,409 | 9/1990 | Tokuda | 123/456 |
| 5,076,242 | 12/1991 | Parker | 123/516 |
| 5,088,463 | 2/1992 | Affeldt | 123/456 |
| 5,143,039 | 9/1992 | Gmelin | 123/456 |
| 5,156,134 | 10/1992 | Tochizawa | 123/468 |
| 5,233,963 | 8/1993 | Gregorius | 123/468 |
| 5,239,964 | 8/1993 | Diener | 123/456 |

FOREIGN PATENT DOCUMENTS

| | | | |
|---|---|---|---|
| 0403871 | 12/1990 | European Pat. Off. . | |
| 508074 | 10/1992 | European Pat. Off. | 123/468 |
| 2248273 | 4/1992 | United Kingdom | 123/468 |
| 2248274 | 4/1992 | United Kingdom | 123/468 |

*Primary Examiner*—Carl S. Miller

*Attorney, Agent, or Firm*—Shlesinger, Arkwright & Garvey

[57] ABSTRACT

The manifold supplies fuel under pressure to a series of fuel metering and atomizing valves, and comprises a first tubular body provided with a series of connections for the valves; a second tubular body arranged approximately coaxially inside the first tubular body to define between these bodies a channel for supplying the fuel to the connections; a first member arranged so as to close off a first axial end of the first tubular body; and a second member arranged so as to close off a second axial end of the first tubular body. The chief characteristic of the manifold lies in the fact that the second member comprises a wall which closes off said first tubular body and that this wall is made in one piece with the first tubular body.

20 Claims, 1 Drawing Sheet

MANIFOLD FOR A SYSTEM FOR SUPPLYING FUEL TO AN INTERNAL-COMBUSTION ENGINE

BACKGROUND OF THE INVENTION

The present innovation relates to a manifold for a system for supplying fuel to an internal-combustion engine. In particular, the manifold supplies fuel under pressure to a series of fuel metering and atomizing valves.

Manifolds of this type normally comprise a first tubular body provided with a series of connections for the aforesaid valves, and a second tubular body arranged coaxially inside the first to define between the first and second tubular bodies a fuel supply channel to said connections. The first and second tubular bodies are closed at a first end by a pressure regulator which maintains the pressure of the fuel inside the supply channel below a preset value, and at a second end by an obturator. The obturator comprises a first cylindrical portion whose diameter is equal to the internal diameter of the first tubular body to enable it to engage in said second end of the first tubular body. The obturator also comprises a second cylindrical portion which extends coaxially from the first portion, its diameter being equal to the internal diameter of the second tubular body so as to engage the second end of the second tubular body when the first portion closes the first tubular body. Lastly, the obturator comprises a seal around said first portion to prevent fuel leaking from the manifold.

Manifolds of the type described above have many drawbacks, the chief of which is that with time said obturator can loose its leaktightness and consequently permit fuel to escape.

SUMMARY OF THE INVENTION

The object of the present innovation is to provide a manifold for a system for supplying fuel to an internal-combustion engine, without the drawback described above.

According to the present innovation a manifold is made for a supply system for an internal-combustion engine, which manifold supplies fuel under pressure to a series of fuel metering and atomizing valves, and comprises a first tubular body provided with a series of connections for said valves; a second tubular body arranged approximately coaxially inside said first tubular body to define between said first and said second tubular bodies a channel for supplying the fuel to said connections; a first member arranged so as to close off a first axial end of said first tubular body and preferably defined by a pressure regulator; and a second member arranged so as to close off a second axial end of said first tubular body; characterized in that said second member comprises a wall which closes off said first tubular body, said wall being made in one piece with said first tubular body.

BRIEF DESCRIPTION OF THE DRAWINGS

The innovation will now be described with reference to the appended drawings, which illustrate a non-restricting embodiment thereof. In the drawings.

DETAILED DESCRIPTION OF THE INVENTION

Figure 1:
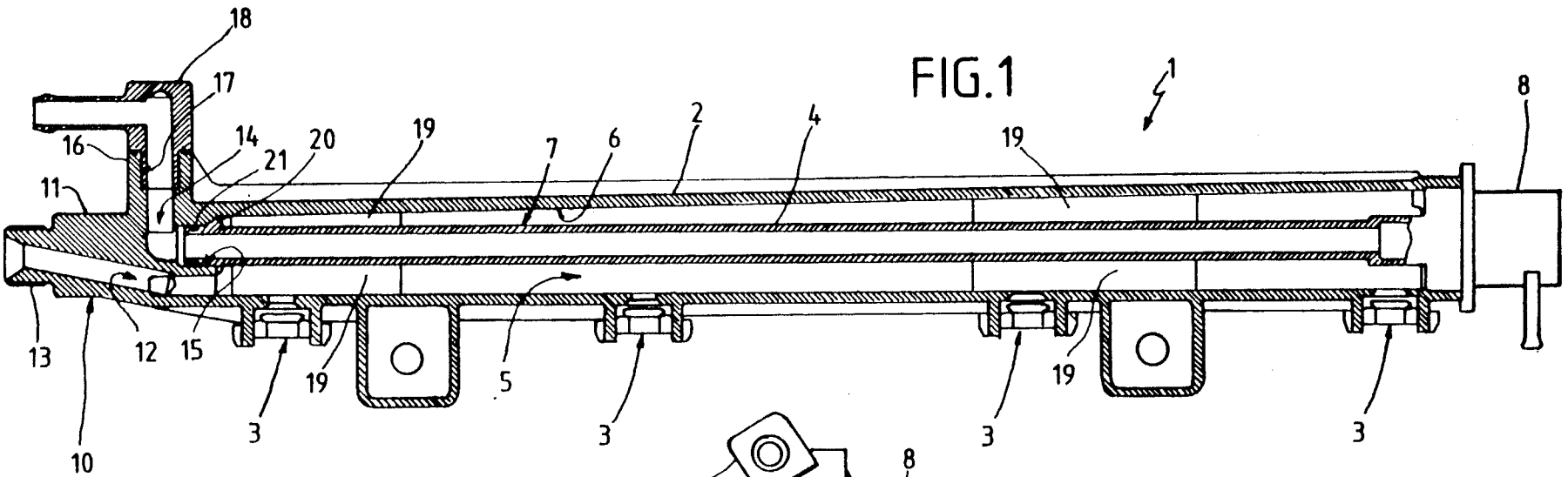
FIG. 1 shows a longitudinal section of a fuel supply manifold made according to the specifications of the present innovation.
Figure 2:
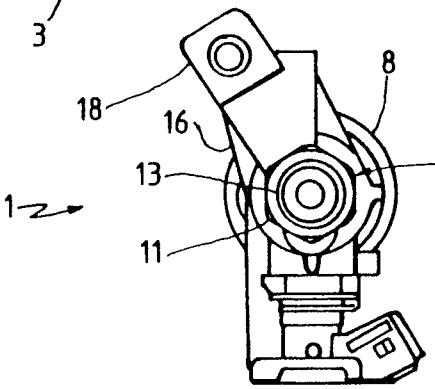
FIG. 2 is a side elevation of the manifold shown in FIG. 1.

With reference to FIG. 1, 1 indicates a manifold for a system for supplying fuel to an internal-combustion engine. The manifold 1 comprises a tubular body 2 provided with a series of connections 3 for fuel metering and atomizing valves, of known type, one being illustrated partially in FIG. 2. The manifold 1 also comprises a second tubular body 4 which is arranged in an approximately coaxial position inside the first body 2 to define with said first body 2 a channel 5. The channel 5 is defined by the internal surface 6 and external surface 7 of the tubular bodies 2 and 4 respectively and communicates with the connections 3 so as to supply fuel to said valves.

The manifold 1 also comprises a first member 8 which closes off the tubular body 2. The member 8 is formed by a known type of pressure regulator mounted so as to close off a first axial end of the tubular body 2 and a first end of the tubular body 4, and maintains the pressure of the fuel inside the channel 5 within a preset range of values. As is known, the pressure regulator has a spring (not shown) as a means of clamping to the manifold 1.

Lastly, the manifold 1 comprises a second member 10 for closing off a second axial end of the tubular body 2. The member 10 comprises a wall 11 made in one piece with the tubular body 2. The wall 11 contains a first duct 12 which starts in a tubular extension 13 and leads into the channel 5. The extension 13 is made in one piece with the wall 11 from whose outer face it projects coaxially with the body 2. The extension 13 is externally threaded to permit a hydraulic coupling with a pipe (not shown) supplying fuel from a tank (not shown). The duct 12, from the inside to the outside of the body 2, is defined by a first section whose axis is parallel to the longitudinal axis of the body 2, by a second section whose axis is at an angle to the axis of the first section, and by a third section whose axis is approximately coaxial with the longitudinal axis of the body 2.

The wall 11 contains a second duct 14 leading in an "L"-shaped path between an inner face of the wall 11 and the lateral surface of this same wall 11. At the inner face of the wall 11, the duct 14 widens out to form a coupling seat 15, sealed off from the channel 5, for an axial end portion of said tubular body 4. In particular, an annular flange 20 is formed at said end portion of the body 4 to abut against the free rim of the seat 15. Furthermore, between the seat 15 and the end portion of the body 4, an annular seal 21 is installed.

Formed in one piece with the wall 11 is a tubular extension 16 which extends radially away from said lateral surface of said wall 11. There passes axially through the extension 16 a terminal section of the duct 14, and at the free end of this extension 16 is a seat 17 providing leaktight accommodation for a first end portion of a body 18, of which a second end portion is provided for attachment to a tube (not shown) for sending fuel to said tank (not shown). The body 18 is "L"-shaped so that the axis of its second end portion is parallel to the longitudinal axis of the body 2.

In the manifold 1, the tubular body 4 also has fins 19 along the channel 5 to center said body 4 in a preset position with respect to the body 2.

The body 2 is made in one piece with the wall 11 by the stamping method in such a way as to define a single aperture produced by the stamp punch; this aperture will later be sealed shut by the pressure regulator. The body 2 may be made in a metal material, preferably rheocast aluminum, or in a plastics material. With the stamping method used for the construction of the body 2, this body is given an internal taper with a small deforming angle. The body 4 may likewise be made of a metal or plastics material.

In use, after manufacture of the body 2 and the wall 11 in one piece with the body 2, the body 4 is inserted into the body 2, the seal 21 having been already fitted onto its first end. The body 4 is inserted until the flange 20 stops against the free rim of the seat 15. After this, the pressure regulator is installed so as to seal off the body 2. The pressure regulator includes a portion which connects with a second axial end of the body 4. As already stated, the pressure regulator has a spring to clamp it against the manifold 1. This spring additionally has the function of pressing the body 4 in the direction of the seat 15 so that the position of the body 4 and the seal between the end portion of the body 4 and the seat 15 are held constant.

The fuel passes along the duct 12 from the tank into the channel 5 and from here is distributed to the metering valves. Should the pressure in the channel 5 rise above a preset value to which the regulator has been calibrated, the regulator compensates for this by recycling the fuel to the tank via the body 4.

It is clear from the aforegoing description what advantages result from the use of the present innovation.

In particular, it provides a manifold whose fuel feeder body has only one obturator (the pressure regulator) since at the further end from this obturator there is a closure wall made in one piece with the feeder body. It is clear that in such a manifold the seal will be more reliable and that as a consequence there will be a marked decrease in the risk of fuel leakage. What is more, the manifold has fewer components than current manifolds owing to the elimination of one member (the obturator at the far end from the pressure regulator), in itself a critical member; whence reduced costs not only of assembly but also of testing. The particular shaping of the closure wall 11 and the presence of the fins 19 enables accurate, fast and efficient assembly of the recyling body 4 along the body 2, and of the pressure regulator at the ends of these bodies 2 and 4. It should be noted, too, that the stamping method enables the body 2 to be manufactured on an industrial scale and at a low cost.

Finally, it will be clear that the manifold 1 here described and illustrated may be subject to modifications and variants without thereby departing from the protective scope of the present innovation.

We claim:

1. A manifold for an internal combustion engine to supply fuel under pressure to a series of fuel atomizing valves, said manifold comprising:

a) a first tubular body having a longitudinal axis and a series of connections fluidly connectable to fuel atomizing valves;

b) a second tubular body disposed approximately coaxially inside said first tubular body and defining between said first and second tubular bodies a channel for supplying the fuel to said connections;

c) a member disposed adjacent to and closing off a first axial end of said first tubular body;

d) said member including a pressure regulator operably connected to said channel and said second tubular body;

e) said first tubular body including an integral wall closing off a second axial end of said first tubular body;

f) said first tubular body including a tubular extension projecting from said integral wall and substantially coaxially with said first tubular body;

g) said tubular extension including an inlet duct fluidly connecting with said channel;

h) said integral wall including an outlet duct fluidly communicating with said second tubular body;

i) said tubular extension being configured for connection to a fuel tank; and j) said inlet duct including a first section having an axis extending substantially parallel to the longitudinal axis of said first tubular body, and a second section having an axis extending at an angle relative to the axis of said first section, and a third section having an axis extending substantially coaxial with the longitudinal axis of said first tubular body.

2. A manifold as in claim 1, and further comprising:

a) fins disposed within said channel to position said second tubular body in a preset position with respect to said first tubular body.

3. A manifold as in claim 1, wherein:

a) said first tubular body is made in one piece with said integral wall and defines a single aperture; and b) said single aperture is sealed shut by said member.

4. A manifold as in claim 3, wherein:

a) said first tubular body is made of rheocast aluminum.

5. A manifold as in claim 3, wherein:

a) said first tubular body is made of a plastic material.

6. A manifold as in claim 1, wherein:

a) said second tubular body is made of a metal material.

7. A Manifold as in claim 1, wherein:

a) said second tubular body is made of a plastic material.

8. A manifold for an internal combustion engine t supply fuel under pressure to a series of fuel atomizing valves, said manifold comprising:

a) a first tubular body having a longitudinal axis and a series of connections fluidly connectable to fuel atomizing valves;

b) a second tubular body disposed approximately coaxially inside said first tubular body and defining between said first and second tubular bodies a channel for supplying the fuel to said connections;

c) a member disposed adjacent to and closing off a first axial end of said first tubular body;

d) said member including a pressure regulator operably connected to said channel and said second tubular body;

e) said first tubular body including an integral wall closing off a second axial end of said first tubular body;

f) said integral wall including an inlet duct fluidly communicating with said channel and an outlet duct fluidly communicating with said second tubular body;

g) said outlet duct being connectable to a fuel tank;

h) said outlet duct being generally "L"-shaped; and i) said outlet duct including a first coupling seat engaged with an axial end portion of said second tubular body to fluidly seal off said outlet duct from said channel.

9. A manifold as in claim 8, wherein:

a) said integral wall includes a tubular extension;
b) said tubular extension extends radially away from said second tubular body;
c) a terminal section of said outlet duct passes axially through said tubular extension;
e) a third body is provided for being fluidly connected to a fuel tank; and
f) said tubular extension includes a second coupling seat engaged with and fluidly sealing an axial end portion of said third body, providing a leaktight seal.

10. A manifold as in claim 8, wherein:
a) a free rim is provided on said first seat;
b) an annular flange is provided at said axial end portion of said second tubular body to abut against the free ri of said first seat; ad
c) an annular seal is disposed between said first seat and said axial end portion of said second tubular body.

11. A manifold as in claim 8, and further comprising:
a) fins positioned along said channel to position sad second tubular body in a preset position with respect to said first tubular body.

12. A manifold as in claim 8, wherein:
a) said first tubular body is made in one piece with said integral wall and defines a single aperture; and
b) said single aperture is sealed shut by said member.

13. A manifold as in claim 12, wherein:
a) said first tubular body is made of rheocast aluminum.

14. A manifold as in claim 12, wherein:
a) said first tubular body is made of a plastic material.

15. A manifold as in claim 8, wherein:
a) said second tubular body is made of a metal material.

16. A manifold as in claim 8, wherein:
a) said second tubular body is made of a plastic material.

17. A manifold for an internal combustion engine to supply fuel under pressure to a series of fuel atomizing valves, said manifold comprising:
a) a first tubular body having a longitudinal axis and a series of connections fluidly connectable to fuel atomizing valves;
b) a second tubular body disposed approximately coaxially inside said first tubular body and defining between said first and second tubular bodies a channel for supplying the fuel to said connections;
c) a member disposed adjacent to and closing off a first axial end of said first tubular body;
d) said first tubular body including an integral wall closing off a second axial end of said first tubular body;
e) said first tubular body including a tubular extension projecting from said integral wall;
f) said tubular extension including an inlet duct fluidly communicating with said channel; and
g) said integral wall including an outlet duct fluidly communicating with said second tubular body.

18. A manifold as in claim 17, wherein:
a) said tubular extension projects from said integral wall substantially coaxially with said first tubular body;
b) said tubular extension being configured for fluidly connecting to a fuel tank; and
c) said member includes a pressure regulator operably connected to said channel and to said second tubular body.

19. A manifold as in claim 17, wherein:
a) said inlet duct includes a first section having an axis extending substantially parallel to the longitudinal axis of said first tubular body, and a second section having an axis extending at an angle to the axis of said first section, and a third section having an axis extending approximately coaxial with the longitudinal axis of said first tubular body.

20. A manifold as in claim 19, wherein:
a) said outlet duct includes a first coupling seat engaged with an axial end portion of said second tubular body to seal off said outlet duct from said channel.

* * * * *

UNITED STATES PATENT AND TRADEMARK OFFICE

CERTIFICATE OF CORRECTION

PATENT NO. : 5,333,587

DATED : August 2, 1994

INVENTOR(S) : Maurizio DiSilvestro and Flavio Giovannini

It is certified that error appears in the above-indentified patent and that said Letters Patent is hereby corrected as shown below:

On the title page, item (30): The Foreign Application Data should read --T092U 000138--.

Signed and Sealed this

Eighth Day of November, 1994

Bruce Lehman

*Attest:*

BRUCE LEHMAN

*Attesting Officer*

*Commissioner of Patents and Trademarks*